US006679479B1

(12) United States Patent
Watkins

(10) Patent No.: US 6,679,479 B1
(45) Date of Patent: Jan. 20, 2004

(54) SCISSOR LIFT MECHANISM

(75) Inventor: Donald Watkins, Beloit, OH (US)

(73) Assignee: Steel Equipment Specialists, LLC, Alliance, OH (US)

( * ) Notice: Subject to any disclaimer, the term of this patent is extended or adjusted under 35 U.S.C. 154(b) by 0 days.

(21) Appl. No.: 10/244,931

(22) Filed: Sep. 16, 2002

Related U.S. Application Data

(60) Provisional application No. 60/391,798, filed on Jun. 27, 2002.

(51) Int. Cl.[7] ..... B66F 9/20

(52) U.S. Cl. ..... 254/9 C; 254/122

(58) Field of Search ..... 254/8 R, 8 B, 254/8 C, 9 R, 9 B, 9 C, 122, 124; 182/153, 191, 158, 12 A; 74/521

(56) References Cited

U.S. PATENT DOCUMENTS

| | | | | |
|---|---|---|---|---|
| 3,412,873 A | * | 11/1968 | Barker | 254/122 |
| 3,658,011 A | | 4/1972 | West et al. | |
| 3,863,785 A | | 2/1975 | Brock | |
| 4,082,195 A | | 4/1978 | Wnek | |
| 4,219,186 A | | 8/1980 | Brewer | |
| 4,288,195 A | | 9/1981 | Brewer | |
| 4,403,680 A | | 9/1983 | Hillesheimer | |
| 4,503,983 A | | 3/1985 | Lew | |
| 5,131,501 A | * | 7/1992 | Yoshikawa | 254/122 |
| 5,460,460 A | | 10/1995 | Alexander | |
| 5,496,146 A | | 3/1996 | Thomas et al. | |
| 5,694,864 A | | 12/1997 | Langewellpott | |
| 5,722,513 A | | 3/1998 | Rowan et al. | |
| 5,829,948 A | | 11/1998 | Becklund | |
| 5,833,198 A | | 11/1998 | Graetz | |
| 5,865,590 A | | 2/1999 | Lilley | |
| 6,176,670 B1 | | 1/2001 | Salsburg | |
| 6,257,372 B1 | | 7/2001 | Schirmer | |

OTHER PUBLICATIONS

Southworth Products Corp., "Southworth Scissor Lift Coil Cars," Brochure, 3 pages, (1996).

* cited by examiner

*Primary Examiner*—Robert C. Watson
(74) *Attorney, Agent, or Firm*—Hahn Loeser & Parks, LLP; Robert J. Clark

(57) ABSTRACT

A scissor lift mechanism for use on a coil car or the like, the lift having scissor legs connected to each other by a shaft. The lift is raised and lowered by a means for providing a generally vertical force to the shaft. The means may be provided by a hydraulic cylinder and a bell crank mechanism. The bell crank mechanism redirects the force from a hydraulic cylinder to a generally vertical force on a hinge connecting the scissor legs of the lift. The bell crank mechanism allows the strength of the lift to be maximized while retaining a low profile design.

21 Claims, 4 Drawing Sheets

FIG 2
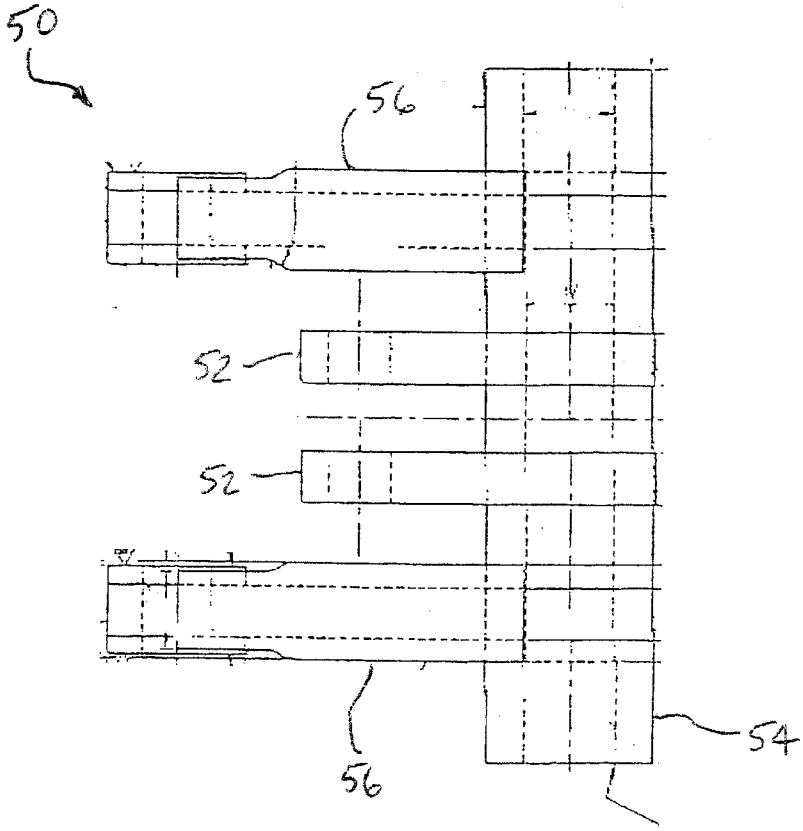
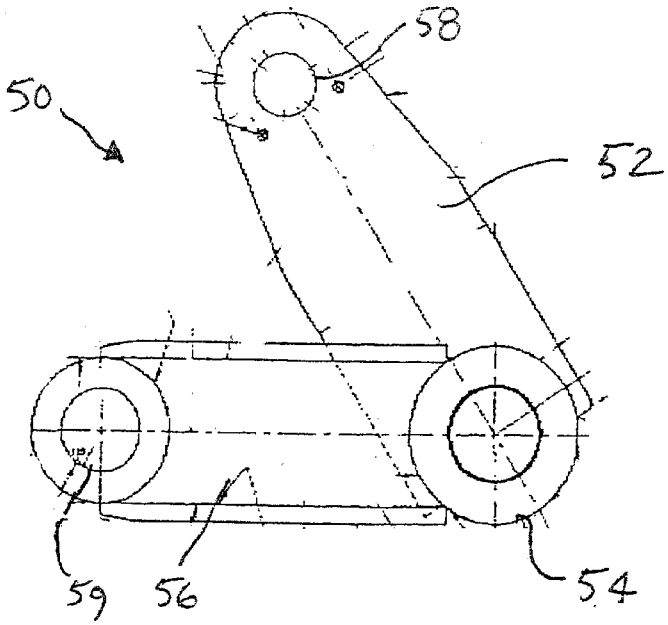
FIG 3

SCISSOR LIFT MECHANISM

This application claims the benefit of provisional application Ser. No. 60/391,798 filed Jun. 27, 2002.

FIELD OF THE INVENTION

The present invention relates generally to a scissor lift and, more particularly, to a low-profile, scissor lift mechanism utilizing a bell crank mechanism for use on a coil car or the like.

BACKGROUND OF THE INVENTION

Scissor lift tables are well known for facilitating the stacking or unstacking of articles on pallets or other supports. The typical lift table incorporates a support platform and a mechanism for selectively raising or lowering the support platform into a position facilitating its loading or unloading. Vertical movement of the support platform usually is accomplished via a scissor arm mechanism that supports the support platform on an underlying base and that is raised and lowered by way of one or more hydraulic or pneumatic cylinders.

On traditional single scissor arm lift mechanisms, the hydraulic cylinder or linear actuator is typically mounted on one scissor arm or the base of the lift and attached to another scissor arm on opposite sides of a scissor pivot point. One problem with these types of mechanisms having generally vertically positioned cylinders is that they typically have a high profile. Low profile, cam style scissor lift mechanisms have been developed in which the hydraulic cylinder is mounted generally horizontally to a lift frame on one side and to a crossmember on the other side. The crossmember engages opposing legs of the pair of scissor arms below the scissor pivot points utilizing needle bearing cam follower leg rollers at either end of the crossmember. The actuation of the hydraulic cylinder forces the crossmember to move along an incline such that, as the hydraulic cylinders extend further, the crossmember is raised vertically and moved horizontally which causes the scissor legs to extend and lift the platform vertically.

However, traditional low profile lift mechanisms still have several problems. The strength of prior art low profile, cam style lift mechanisms is significantly lower in that they typically have a capacity rated below 30,000 pounds. Uneven loads produce significant torsional loads on the scissor legs and other support members of prior art low profile lift mechanisms. In addition, the friction and eccentric loading between the sliding/rolling members add work and produce wear on the mechanisms and the hydraulic cylinder. Another problem with the prior art lifts is that the mechanisms deflect significantly under load and have large differences in strength ratings between the retracted and the extended positions.

These and other problems in the prior art reveal the need for a new lift mechanism which overcomes one or more of the above-mentioned problems.

SUMMARY OF THE INVENTION

It is an object of the invention to provide an improved lift mechanism utilizing a bell crank style crank arm assembly for use with a low profile scissor lift which overcomes one or more of the problems identified with the prior art. These and other advantages are provided by a scissor lift comprising: a frame; a deck moveable relative to the frame between an extended and a retracted position; a first leg supporting the deck on the frame having a first end pivotally attached to the frame, a second end slidably and pivotally attached to the deck, and an intermediate portion therebetween; a second leg supporting the deck on the frame having a first end slidably and pivotally attached to the frame, a second end pivotally attached to the deck, and an intermediate portion therebetween; wherein the second leg is transverse to the first leg and wherein the intermediate portions of the first leg and the second leg are pivotally connected about a first shaft; and a means for applying a generally vertical force to the first shaft to move the deck between a retracted position and an extended position.

BRIEF DESCRIPTION OF THE DRAWINGS

Better understanding of the present invention will be had when reference is made to the accompanying drawings, wherein identical parts are identified with identical reference numerals, and wherein:

FIG. 2 is an end elevational view of the crank arm assembly of the lift mechanism of the present invention;

FIG. 3 is a top plan view of the crank arm assembly of FIG. 2;

DETAILED DESCRIPTION OF THE DRAWINGS

Figure 1:
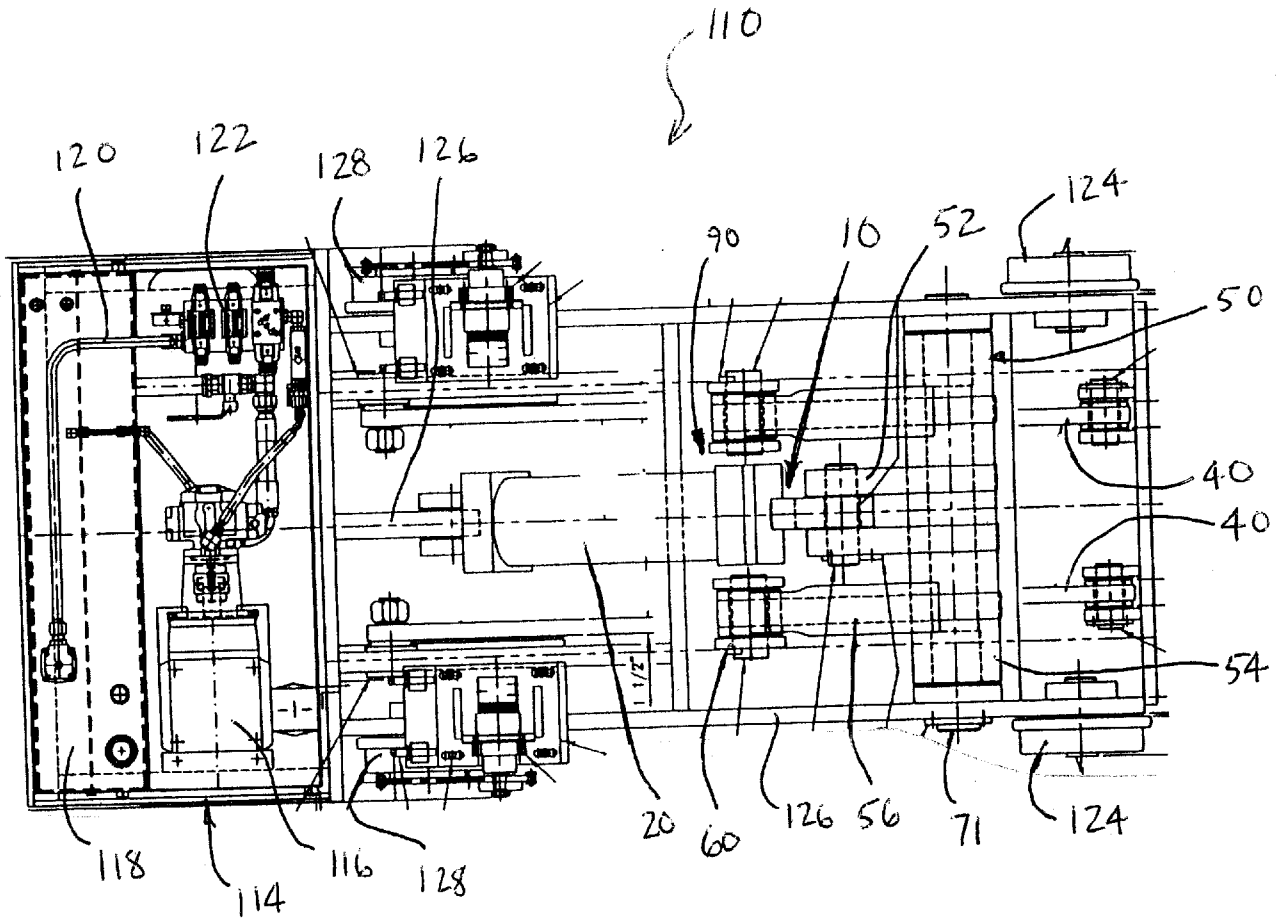
FIG. 1 is a top plan view of a scissor lift coil car comprising the lift mechanism of the present invention, having the platen and portions of the scissor arms removed to provide a clearer view to the interior components of the car and the lift mechanism.

Referring now to FIG. 1, the top view of a scissor lift coil car 110 including scissor lift 10 is shown with the platen or deck 80 removed for clarity. The scissor lift coil car 110 comprises a hydraulic power unit 114 typically including a combination electric motor pump 116, a hydraulic reservoir 118, and associated hydraulic fluid hoses 120, and hydraulic control valves 122. The scissor lift coil car 110 is mounted on idler wheels 124 and driven wheels 128 which provide transverse drive for the scissor lift coil car 110. Although not shown, it is contemplated that the present invention could be used in other applications other than coil cars or in coil cars having different configurations.

Figure 5:
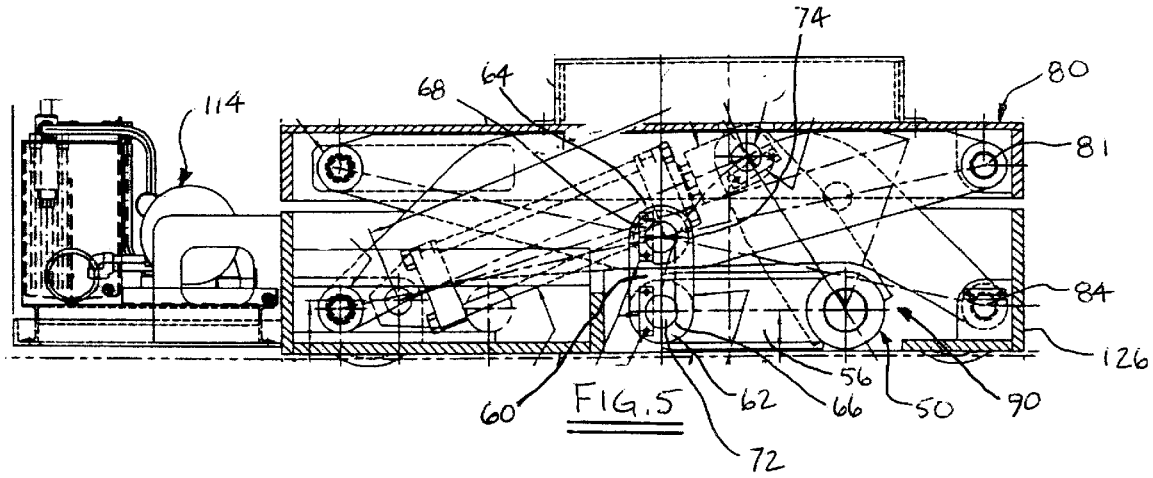
FIG. 5 is a side elevational view of the scissor lift roll car utilizing the scissor lift mechanism of the present invention in the retracted position.
Figure 4:
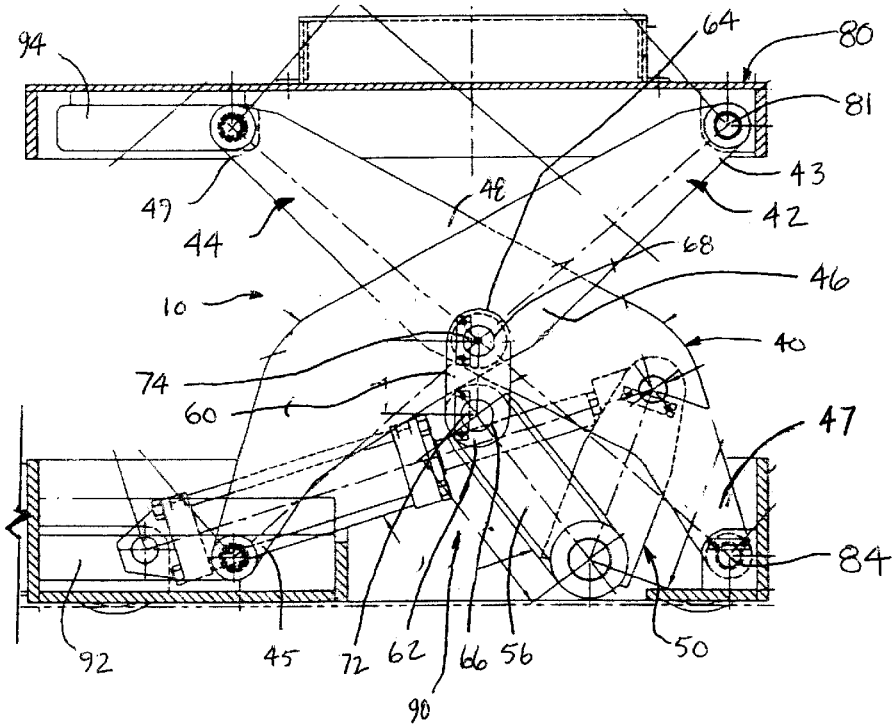
FIG. 4 is a side elevational view of the scissor lift roll car utilizing the scissor lift mechanism of the present invention in the extended position.

The scissor lift 10 comprises a frame 126, a deck 80 moveable relative to the frame 126 between an extended and a retracted position, and scissor legs 40 as best shown in FIGS. 4 and 5. The scissor legs 40 comprise a first leg 44 supporting the deck 80 on the frame 126 having a first end 47 pivotally attached to the frame 112, a second end 49 slidably and pivotally attached to the deck 112, and an intermediate portion 48 therebetween; and a second leg 42 supporting the deck 80 on the frame 126 having a first end 45 slidably and pivotally attached to the frame 126, a second end 43 pivotally attached to the deck 80, and an intermediate portion 46 therebetween. The second leg 42 is transverse to the first leg 44 and the intermediate portions 48, 46 of the first leg 44 and the second leg 42 are pivotally connected about a first shaft 74. The scissor lift typically has two sets of scissor legs 40 to provide a balanced lift, however, the present invention is not limited as such. Although not shown, it is also contemplated that additional pairs of scissor legs 40 may be attached end to end to increase the lift height of the lift. The scissor lift 10 further comprises a means 90 for applying a generally vertical force to the first shaft 74 to move the deck 80 between a retracted position and an extended position. The means 90 may comprise at least one hydraulic cylinder 20, a crank arm assembly 50, and at least one coupler member 60. The hydraulic cylinder 20 is mounted at a first end 22 to the frame 126 of the scissor lift 10. A second end 24 of hydraulic cylinder 20 is mounted to a pair of upper arms 52 of the crank arm assembly 50.

The crank arm assembly 50 is best shown in FIGS. 2 and 3 and comprises the upper arms 52, a collar 54, and a pair of lower arms 56. The collar 54 is in the form of a cylindrical tube which is rotatably mounted on a through shaft 71 attached at either end to frame member 126 as shown in FIG. 1. Referring again to FIGS. 2 and 3, the upper arms 52 of crank arm assembly 50 are fixably attached to the collar 54 and are generally positioned equidistant from the midpoint of collar 54. The upper arms 52 each have an aperture 58 at a distant end thereof for attachment to the second end 24 of hydraulic cylinder 20 by a shaft 70. The pair of lower arms 56 of the crank arm assembly 50 are fixedly attached to collar 54 at a predetermined angle with respect to the upper arms 52. The lower arms 56 each have an aperture 59 at a distant end thereof for attachment to the connector members 60 by a shaft 72 as discussed in detail below. The crank arm assembly 50 is formed such that rotation of the upper arms 52 in either the clockwise or counterclockwise direction, results in rotation of collar 54 and lower arms 56. In operation, the lift mechanism 10 utilizes the crank arm 50 as a bell crank which redirects the input force applied to the upper arms 52 by the hydraulic cylinder 20 to an output force at the lower arms 56 moving the connector plates 60 and scissor arms 40. The fulcrum of the bell crank is the collar 54 rotating about the shaft 71. While the ends of the upper arms 52 and the lower arms 56 are at equal distances from collar 54, it is contemplated that these distances could be modified to obtain some degree of mechanical advantage.

Referring again to FIGS. 4 and 5 in more detail, the scissor legs 40 of the lift mechanism 10 comprise a pair of first legs 42, each rotatably attached to one leg of a pair of second legs 44 about a pivot point formed by connecting shaft 74 on either side of the scissor lift car 110 as previously discussed. Each first end 43 of first leg 42 is rotatably attached about a fixed pivot point 81 of deck 80 and each second end 45 of each first leg 42 is pivotally and slidably attached to a slot 92 of base frame 126. Each first end 47 of second leg 44 is rotatably attached about a fixed pivot point 84 of base frame 126 and each second end 49 of each second leg 44 is pivotally slidably attached to a slot 94 of platen 80. The scissor legs 40 of mechanism 10 are shown in an elevated platen position in FIG. 4 and a retracted platen position in FIG. 5.

The lift mechanism 10 utilizes the connector members 60 to connect the crank arm 50 to the scissor legs 40. The connector members 60 are formed as plates having a first end 62 having a first aperture 66 and a second end 64 having a second aperture 68. The first ends 62 of a pair of connector plates 60 are connected on opposite sides of the each lower arm 56 of crank arm assembly 50 by shaft 72 position through apertures 66 and 59, respectively. The second ends 64 of the pair of connector plates 60 are connected to the exterior sides to the scissor legs 40 by connecting shaft 74. It is noted that the shaft 71 and 72 are generally vertically aligned throughout the movement between the extended and retracted scissor lift configuration.

In operation, the lift mechanism 10 of the present invention is raised to an extended position by actuation of the hydraulic cylinder 20. The hydraulic cylinder 20 causes the rotation of crank arm 50. Crank arm 50 moves the connector plates 60 and shaft 74. As the shaft 74 moves generally upward, the second end 45 of each first leg 42 rotates about its fixed first end 43 and the first end 47 of each second leg 44 rotates about its fixed second end 49. The scissor action of legs 40 raises the platen 80. In the configuration shown, the ratio of elevation to the hydraulic cylinder stroke is generally about 2:1.

The deck 80 or platen may be of any known type commonly used with lifts such as, but not limited to, vee cradles, rolls, flat platform, retaining bars, turntables, tilts, etc.

The lift mechanism 10 of the present invention provides several advantages over the prior art lift mechanisms. One advantage is that uneven loads are transmitted straight down to the frame 126 through the connection point at shaft 74 to connectors 60, to the crank arm 50 and hydraulic cylinder 20. This prevents the high torsional loads that are associated with off-center loads in the prior art. Another advantage of the lift mechanism 10 of the present invention is that the centralized design makes the lift mechanism less prone to deflect under high loads. The lift mechanism 10 is generally the same strength in the extended position as that in the retracted position. This is important when the application requires the heaviest loads to be supported in the extended position.

Figure 6:
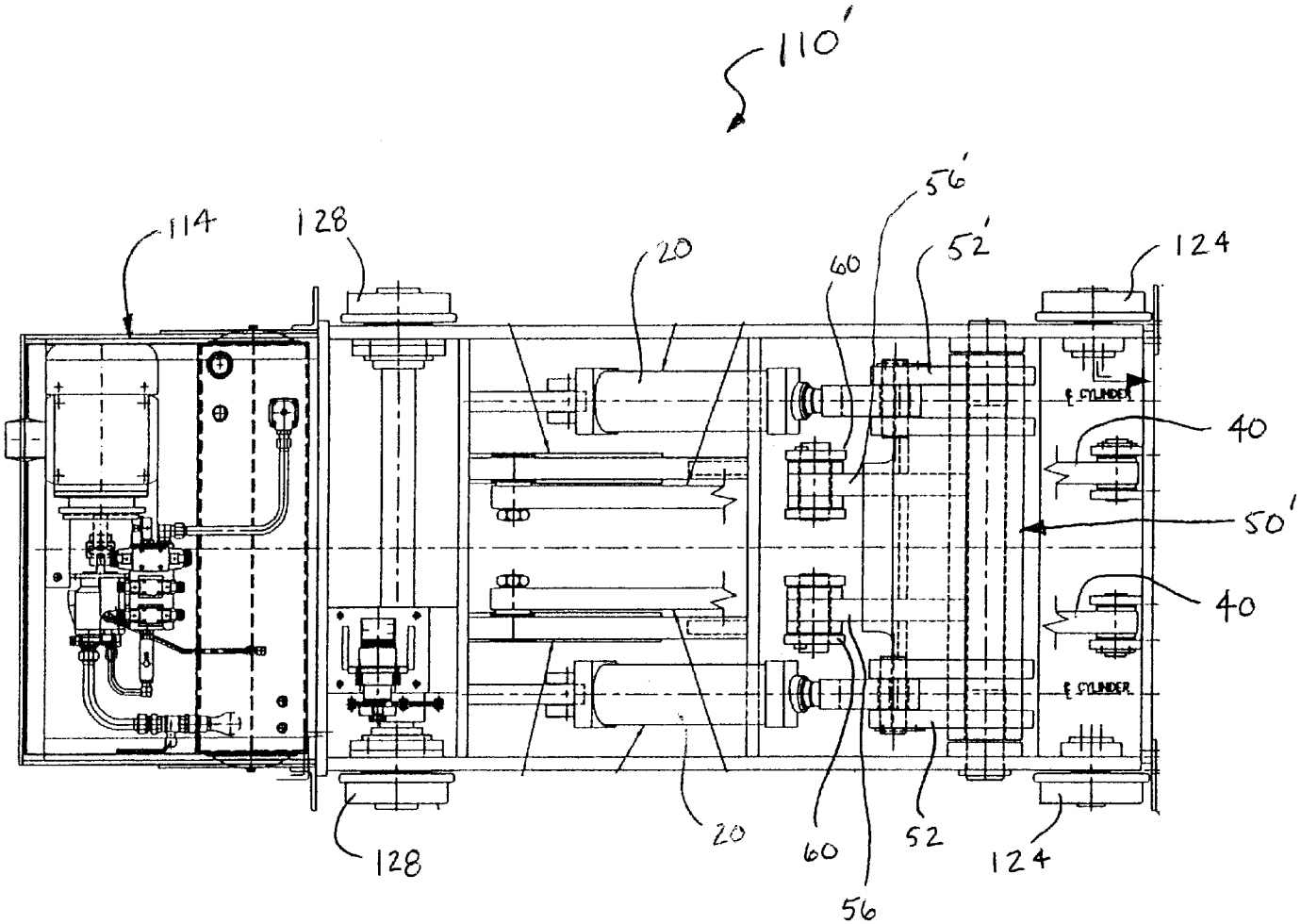
FIG. 6 is a top plan view of an alternate embodiment of the lift mechanism of the present invention, having the platen and portions of the scissor arms removed to provide a clearer view to the interior components of the car and the lift mechanism.

Referring now to FIG. 6, an alternate embodiment of the lift mechanism 10' is shown having two cylinders 20. The additional cylinder 20 may increase the lift capacity of the lift. The cylinders 20 are symmetrically offset from the center and positioned having the scissor legs 40 positioned between them, although not limited to this particular configuration. The crank arm 50' comprises two sets of upper arms 52'. Both sets of upper arms 52' are symmetrically offset from the center of the crank arm 50' to correspond and connect with the two hydraulic cylinders 20. The lower arms 56' are positioned between the upper arms 52' corresponding to the positioning of the legs 40.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A scissor lift comprising:

a frame;

a deck moveable relative to the frame between an extended and a retracted position;

a first leg supporting the deck on the frame having a first end pivotally attached to the frame, a second end slidably and pivotally attached to the deck, and an intermediate portion therebetween;

a second leg supporting the deck on the frame having a first end slidably and pivotally attached to the frame, a second end pivotally attached to the deck, and an intermediate portion therebetween;

wherein the second leg is transverse to the first leg and wherein the intermediate portions of the first leg and the second leg are pivotally connected about a first shaft;

a means for applying a generally vertical force to the first shaft to move the deck between a retracted position and an extended position;

wherein the means for applying a generally vertical force to the first shaft comprises: a bell crank mechanism comprising a first arm and a second arm extending from a fulcrum portion, the fulcrum portion pivotally attached to the frame; at least one hydraulic cylinder pivotally attached at a first end to the frame and pivotally attached at a second end to the first arm of the bell crank mechanism; and a connector member pivotally attached at a first end to the second arm of the bell crank mechanism and attached at a second end to the shaft.

2. The scissor lift of claim 1, wherein the second arm of the bell crank mechanism is positioned above the shaft when the lift is in the retracted position and below the shaft when the lift is in the extended position.

3. The scissor lift of claim 1, wherein the fulcrum portion of the bell crank mechanism comprises a hollow shaft rotatable about a shaft fixably attached at each end to the frame.

4. The scissor lift of claim 1, wherein the first arm of the bell crank mechanism extends at a predetermined angle from the second arm of the bell crank mechanism.

5. The scissor lift of claim 4, wherein the predetermined angle between the first arm and the second arm of the bell crank mechanism is an acute angle.

6. The scissor lift of claim 1, wherein the connector member is generally oriented vertically such that the pivotal attachment of the first end of the connector member to the second arm of the bell crank mechanism is below the attachment of the second end of the connector member to the shaft in a vertical plane.

7. The scissor lift of claim 1, wherein the at least one hydraulic cylinder pivotally attached at a first end to the frame and pivotally attached at a second end to the first arm of the bell crank mechanism comprises at least two hydraulic cylinders each pivotally attached at a first end to the frame and pivotally attached at a second end to one of the pair of first arms of the bell crank mechanism.

8. The scissor lift of claim 1, wherein the frame is mounted on wheels for use as a coil car.

9. A scissor lift comprising:

a frame;

a deck moveable relative to the frame between an extended and a retracted position;

a first leg supporting the deck on the frame having a first end pivotally attached to the frame, a second end slidably and pivotally attached to the deck, and an intermediate portion therebetween;

a second leg supporting the deck on the frame having a first end slidably and pivotally attached to the frame, a second end pivotally attached to the deck, and an intermediate portion therebetween;

wherein the second leg is transverse to the first leg and the intermediate portions of the first leg and the second leg are pivotally connected about a shaft;

at least one hydraulic cylinder pivotally attached to the frame;

a bell crank mechanism attached to the frame, wherein the bell crank mechanism converts a force applied by actuation of the at least one hydraulic cylinder in a first direction to a force applied to the shaft in a second direction to move the deck between an extended and a retracted position.

10. The scissor lift of claim 9, wherein the bell crank mechanism comprising a first arm and a second arm extending from a fulcrum portion, the fulcrum portion pivotally attached to the frame.

11. The scissor lift of claim 10, wherein the at least one hydraulic cylinder is pivotally attached at a first end to the frame and pivotally attached at a second end to the first arm of the bell crank mechanism.

12. The scissor lift of claim 10 further comprising a connector member pivotally attached at a first end to the second arm of the bell crank mechanism and attached at a second end to the shaft.

13. The scissor lift of claim 10, wherein the fulcrum portion of the bell crank mechanism comprises a hollow shaft rotatable about a shaft fixably attached at each end to the frame.

14. The scissor lift of claim 10, wherein the first arm of the bell crank mechanism extends at a predetermined angle from the second arm of the bell crank mechanism.

15. The scissor lift of claim 14, wherein the predetermined angle between the first arm and the second arm of the bell crank mechanism is an acute angle.

16. The scissor lift of claim 10, wherein the first arm and the second arm are the same length.

17. The scissor lift of claim 13 comprising at least two hydraulic cylinders.

18. The scissor lift of claim 17 wherein the legs supporting the deck are positioned between the at least two hydraulic cylinders.

19. The scissor lift of claim 13, wherein the ratio of the stroke of the at least one hydraulic cylinder to the deck travel is about 1:2.

20. The scissor lift of claim 12, wherein the connector member is generally oriented vertically such that the pivotal attachment of the first end of the connector member to the second arm of the bell crank mechanism is below the attachment of the second end of the connector member to the shaft in a vertical plane.

21. The scissor lift of claim 13, wherein the frame is mounted on wheels for use as a coil car.

* * * * *

UNITED STATES PATENT AND TRADEMARK OFFICE

CERTIFICATE OF CORRECTION

PATENT NO. : 6,679,479 B1
DATED : January 20, 2004
INVENTOR(S) : Donald M. Watkins It is certified that error appears in the above-identified patent and that said Letters Patent is hereby corrected as shown below:

Column 6,
Lines 38, 43 and 52, replace "17. The scissor lift of claim 13," with -- 17. The scissor lift of claim 9, --.

Signed and Sealed this

Sixteenth Day of March, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,679,479 B1
DATED : January 20, 2004
INVENTOR(S) : Donald M. Watkins It is certified that error appears in the above-identified patent and that said Letters Patent is hereby corrected as shown below:

Column 6,
Line 38, replace "17. The scissor lift of claim 13," with -- 17. The scissor lift of claim 9, --.
Line 43, replace "19. The scissor lift of claim 13," with -- 19. The scissor lift of claim 9, --.
Line 52, replace "21. The scissor lift of claim 13," with -- 21. The scissor lift of claim 9, --.

This certificate supersedes Certificate of Correction issued March 16, 2004.

Signed and Sealed this

Twenty-seventh Day of April, 2004

JON W. DUDAS
*Acting Director of the United States Patent and Trademark Office*